US006546953B1

(12) United States Patent
Kowalke

(10) Patent No.: US 6,546,953 B1
(45) Date of Patent: Apr. 15, 2003

(54) HOSE STORAGE DEVICE

(76) Inventor: Steven Kowalke, 603 Sixth St., Baraboo, WI (US) 53913

( * ) Notice: Subject to any disclaimer, the term of this patent is extended or adjusted under 35 U.S.C. 154(b) by 0 days.

(21) Appl. No.: 09/879,646

(22) Filed: Jun. 12, 2001

Related U.S. Application Data

(60) Provisional application No. 60/211,103, filed on Jun. 12, 2000.

(51) Int. Cl.[7] ..... B65H 75/34

(52) U.S. Cl. ..... 137/355.16; 137/355.26; 137/355.28; 137/360

(58) Field of Search ..... 137/377, 355.16, 137/355.26, 355.27, 360, 355.28

(56) References Cited

U.S. PATENT DOCUMENTS

| | | | |
|---|---|---|---|
| 2,216,384 | A | 10/1940 | Brown |
| 2,367,141 | A | 1/1945 | Rosenblum |
| 3,183,927 | A | 5/1965 | Weese et al. |
| 4,520,872 | A | 6/1985 | Holman |
| 4,529,148 | A | 7/1985 | Hesprich et al. |
| 4,588,083 | A | 5/1986 | Hunt |
| 4,844,373 | A | 7/1989 | Fike, Sr. |
| 5,011,034 | A | 4/1991 | Abel |
| 5,404,900 | A | 4/1995 | Fletchall |
| 5,526,842 | A | 6/1996 | Christensen |
| 5,568,824 | A | 10/1996 | Cordrey |
| 5,678,596 | A | 10/1997 | Corallo |
| 5,678,599 | A | 10/1997 | Moss |

*Primary Examiner*—A. Michael Chambers
(74) *Attorney, Agent, or Firm*—Michael, Best & Friedrich LLP; Teresa J. Welch; Jeffrey D. Peterson

(57) ABSTRACT

A hose concealing device which hides a hose when it is not intended to be used and which allows access to the hose when it is desirable to use the hose.

22 Claims, 5 Drawing Sheets

HOSE STORAGE DEVICE

CROSS-REFERENCE TO RELATED APPLICATION

This application claims the benefit of U.S. Provisional Application No. 60/211,103, filed Jun. 12, 2000.

FIELD OF THE INVENTION

The present invention relates to storage devices for hoses and the like and, more particularly, to storage devices that are adapted to conceal a hose or similar piece of equipment until such time as it is desirable to use the hose or other equipment.

BACKGROUND OF THE INVENTION

Garden hoses or other flexible, elongated material which are stored within a container, hanging off of a supporting structure such as a wall on a building, or laying loosely on the ground present many problems. For example, one problem concerns the lack of ease associated with removing a hose from and replacing the hose into a storage device. Another problem concerns the somewhat unsightly appearance associated with certain visible hose storage devices, a loose hose sprawled about the ground, or even a coiled hose placed near a spigot. Another problem is that an exposed hose is subject to damage from pedestrian and vehicular traffic, sharp objects, being chewed up by an animal such as a dog, or other external influences. Another problem relates to safety concerns. An uncoiled hose may get caught underfoot causing a person walking thereover to trip and fall, possibly leading to injury of the person. Moreover, a person could walk or run into a spike or arm extending from a wall from which a coiled hose may be hung, also leading to injury of the person. These are just a few problems generally known in the art. There are other problems.

SUMMARY OF THE INVENTION

The present invention addresses the above-mentioned problems and other problems by providing a new and improved hose storage device. A hose is positioned within an open area of the hose storage device. The hose remains in the hose storage device except when it is desirable to use the hose. The hose storage device may be positioned below the surface of the ground, or the hose concealing device may be configured to be an aesthetically pleasing container which is then positionable on the ground. The hose is easily accessible for use, yet concealed in a safe place when it is not intended for use.

Accordingly, the present invention provides a hose storage or concealing device which is of a simple construction, which is reliable and efficient in operation, which is also easy to manipulate or use, which is capable of concealing a hose from view when the hose is inactive, and which is relatively inexpensive to manufacture and install.

Other features and advantages of the invention will become apparent to those skilled in the art upon review of the following detailed description, claims and drawings in which like numerals are used to designate like features.

Figure 1:
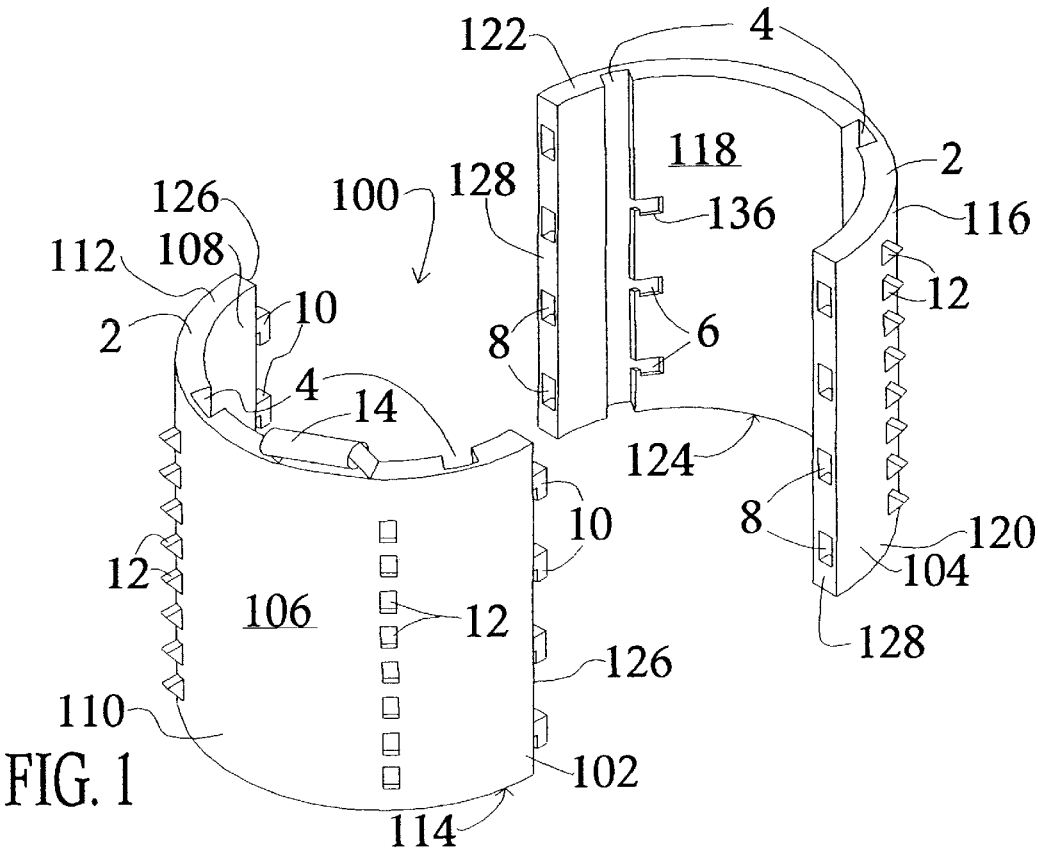
FIG. 1 is an exploded perspective view of a main housing of a hose storage device according to the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof.

BRIEF DESCRIPTION OF THE INVENTION

Referring to the drawings, this invention will be seen to relate to concealing, protecting and neatly storing a hose within a housing or storage container.

Illustrated in FIGS. 1–6 is a first embodiment of a hose storage or concealing device 100 according to the present invention. With reference to FIG. 1, a main housing 2 has a first portion 102 and a second portion 104. Each portion 102 and 104 has a semi-cylindrical shape, but may be of other shapes consistent with the teachings of the present invention. Portion 102 includes a main body 106 having an inner surface 108 and an outer surface 110, both of which extend between a top end 112 and a bottom end 114. Portion 104 includes a main body 116 having an inner surface 118 and an outer surface 120, both of which extend between a top end 122 and a bottom end 124. The first portion 102 includes a plurality of spaced apart locking hooks 10 projecting from a pair of engagement surfaces 126. The second portion 104 includes a plurality of spaced apart locking recesses 8, one for each locking hook 10, formed in a pair of engagement surfaces 128. The recesses 8 receive the hooks 10 in such a manner to form the main housing 2 into a cylinder (see FIG. 6). The recesses 8 and hooks 10 are configured such that once connected, they cannot come apart absent an intervening force. In the final assembled form, surfaces 126 of the first portion 102 respectively engage surfaces 128 of the second portion 104. Alternative locking mechanisms or other configurations may be employed, so long as the main housing 2 is separable into two or more pieces, and so long as the main housing 2 can be assembled together to form a holding device. It should be noted that the main housing 2 could be made of a singular construction, such as a cylindrical container, but it is preferable to utilize at least two pieces for convenient storage and other purposes.

Figure 2:
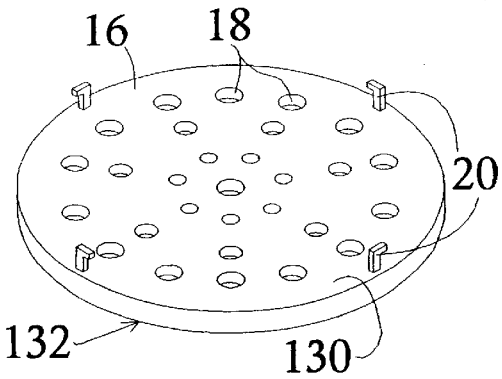
FIG. 2 is a perspective view of a bottom of the hose storage device of FIG. 1.
Figure 5:
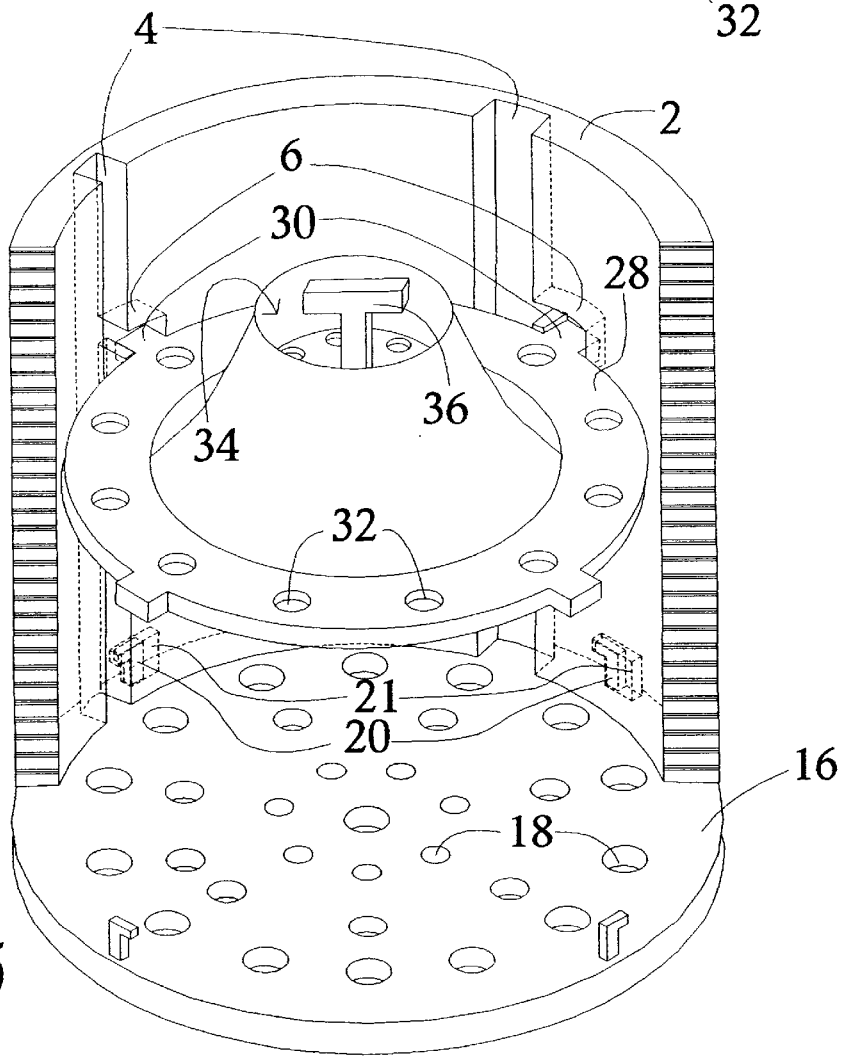
FIG. 5 is a partial cross-sectional view illustrating the cooperation between and assembly of the components of the hose storage device shown in FIGS. 1, 2 and 4.
Figure 6:
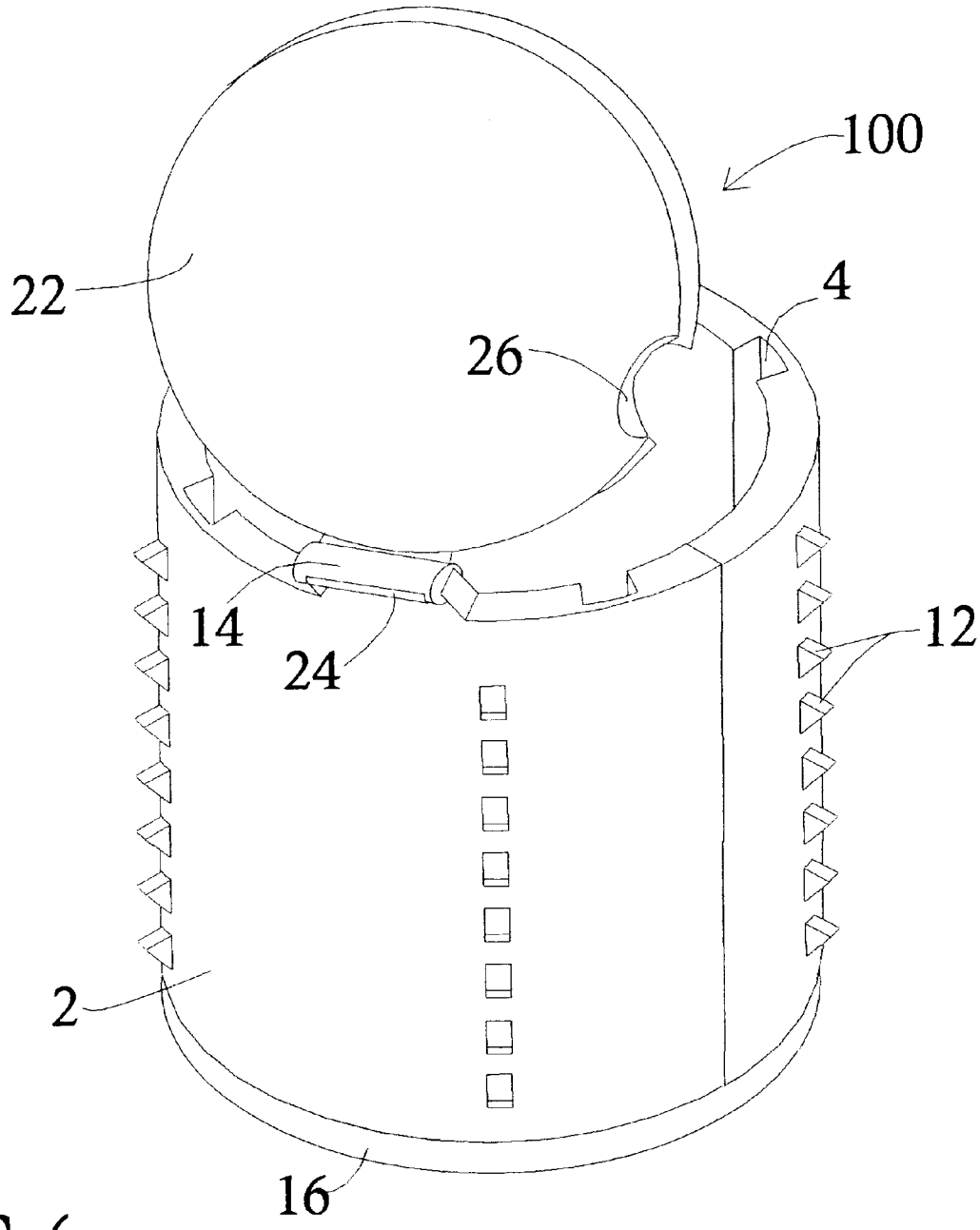
FIG. 6 is a perspective view of the main housing of the hose storage device of FIG. 1 as assembled, and the lid of FIG. 3 positioned thereon.

FIG. 2 illustrates a bottom 16 for the hose storage device 100. The bottom 16 includes a top surface 130 and a bottom surface 132. Since the main housing 2 has a cylindrical shape, the bottom 16 has a circular shape. However, the bottom 16 can be of other shapes and sizes in accordance with the principles of the present invention. A plurality of bottom locking hooks 20 extend from and around the circumference of the top surface 130. With reference to FIG. 5, the bottom ends 114 and 124 (FIG. 1) of the main housing 2 include bottom locking recesses 21, one for each bottom locking hook 20. The recesses 21 receive the hooks 20, and with a slight twist or turn of the bottom 16 relative to the main housing 2, the bottom 16 is secured to the main housing 2. Alternative connecting or locking mechanisms can be employed, so long as the bottom 16 is securely attached to the main housing 2. If the main housing 2 is of a one piece construction, a separate, attachable bottom would not be necessary. However, as indicated above, a modularized hose containing device is preferred for storage purposes (such as for inventory or display purposes). The bottom 16 further includes a plurality of weep holes 18 extending therethrough. Since the hose storage device 100 may be used to store garden hoses or be open from time to time to the outside environment, the weep holes 18 will allow any water collected within the device 100 to drain out of the bottom 16.

Figure 3:
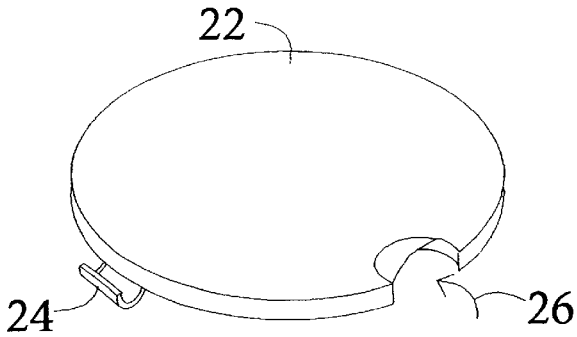
FIG. 3 is a perspective view of a lid of the hose storage device of FIG. 1.

FIG. 3 illustrates a lid 22 for the hose container device 100. As with the bottom 16, since the main housing 2 has a cylindrical shape, the lid 22 has a circular shape. As should be understood, the lid 22 can be of other shapes and sizes. In conjunction with FIG. 1, top end 112 of the main housing 2 includes a hinge 14. The lid 22 includes a hinge receiver 24 which receives the hinge 14 (see FIG. 6). This allows the lid 22 to be opened and closed as desired. Of course, the lid 22 could be connected to the main housing 2 in other suitable ways, so long as the lid 22 can be opened and closed at will. Such other suitable ways may include a latching mechanism, a snap-fit connection between the lid and the main housing, a releasable latch which can be activated by a user's foot, or the lid may simply rest on the main housing. In any event, it is noted that the lid 22 preferably includes a hose outlet 26 so that a hose can be passed therethrough, for those times when one would like to use the hose and perhaps close the lid for safety reasons, i.e., so nobody will fall into the open area of the hose storage device 100. Thus, it should be apparent that the lid 22 is of suitable construction to hold a sufficient amount of weight so that anyone walking over the hose storage device 100, i.e., such as when the hose storage device is positioned beneath the surface of the ground, will not cause the lid to break which, if did happen, could lead to the person falling into the hose storage device.

Figure 4:
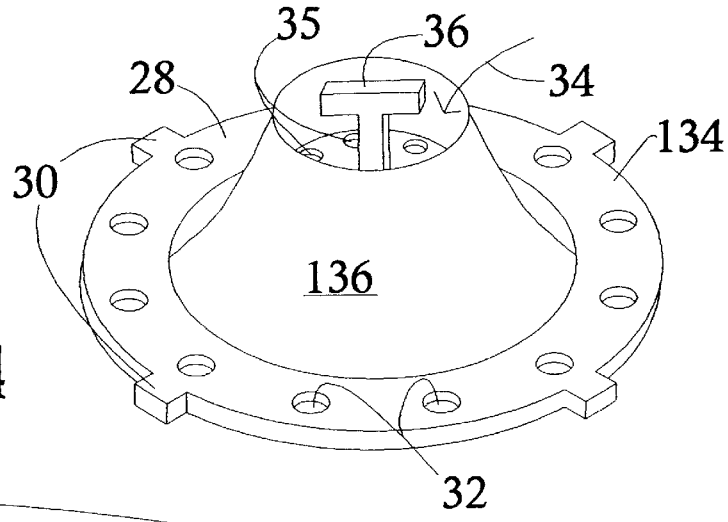
FIG. 4 is a perspective view of a hose rest of the hose storage device of FIG. 1.

Referring again to FIG. 1, it can be observed that the inner surface 118 of the portion 104 of the main housing 2 includes a pair of vertical grooves 4. A plurality of hose rest locking grooves 6 extend from and cooperate with the vertical grooves 4. Portion 102 includes similar grooves 4 and 6. FIG. 4 illustrates a hose rest 28 which is adjustably positionable within the main housing 2 as will be further explained below. The hose rest 28 includes an annular support surface 134, which can be of a different shape depending on the configuration of the main housing 2. The hose rest 28 further includes a tapered or cone shaped middle column 136. A hose (not shown) can be easily coiled around the tapered column 136 and supported by the support surface 134 for storage, and the hose can be easily uncoiled from the tapered column 136 for ultimate use. A plurality of hose rest tabs 30, one for each groove 4 of the main housing 2, extend horizontally outward from the support surface 134. Alternatively, a hose reel (not shown) could be provided within the main housing 2 in place of the cone column 136 for coiling and uncoiling a hose.

With reference to FIG. 5, it can be observed that the each hose rest tab 30 is movable along an associated groove 4. Each hose rest tab 30 mates with an associated hose rest locking groove 6 when the desired location for the host rest 28 with respect to the main housing 2 is obtained. The host rest tabs 30 and associated host rest locking grooves 6 enable the hose rest 28 to be located at different depths in the main housing 2. If the hose rest 28 is placed near the top of the main housing 2, a shorter hose will generally be utilized. If the hose rest 28 is placed near the bottom of the main housing 2, a longer hose will generally be utilized. The hose rest 28 is easily moved to different depths or locations within the main housing 2 by slightly lifting the hose rest 28 with the hose rest handle 36 from the lower slots 136 (FIG. 1) of the hose rest locking grooves 6, and simply turning the hose rest 28 with the hose rest handle until the hose rest tabs 30 are in the grooves 4, thereby allowing for vertical movement of the hose rest 28.

Referring again to FIG. 4, the hose rest 28 includes a storage area 34 defined by the tapered column 136. Various small gardening accessories, hose attachments, or the like can be stored within the storage area 34 when such tools are not being used. The hose rest 28 also includes a plurality of weep holes 32 and 35 to prevent the accumulation of water within the main housing 2.

As noted, in one embodiment, the hose storage device 100 is positioned below the ground surface. A plurality of stabilizing teeth 12 (see, e.g., FIG. 1) are preferably provided on the outer surfaces 110 and 120 of the main housing 2 to assist in securing the device 100 in the ground. The hose storage device 100 is preferably positioned in close proximity to an exterior faucet or spigot. The lid 22 is preferably configured to be flush with the surface of the ground and is the only part of the device 100 which can be seen when the device 100 is not in use. For even further concealment, the top of the lid 22 can be of a green color or any other suitable color to blend in with the surrounding environment.

Figure 7:
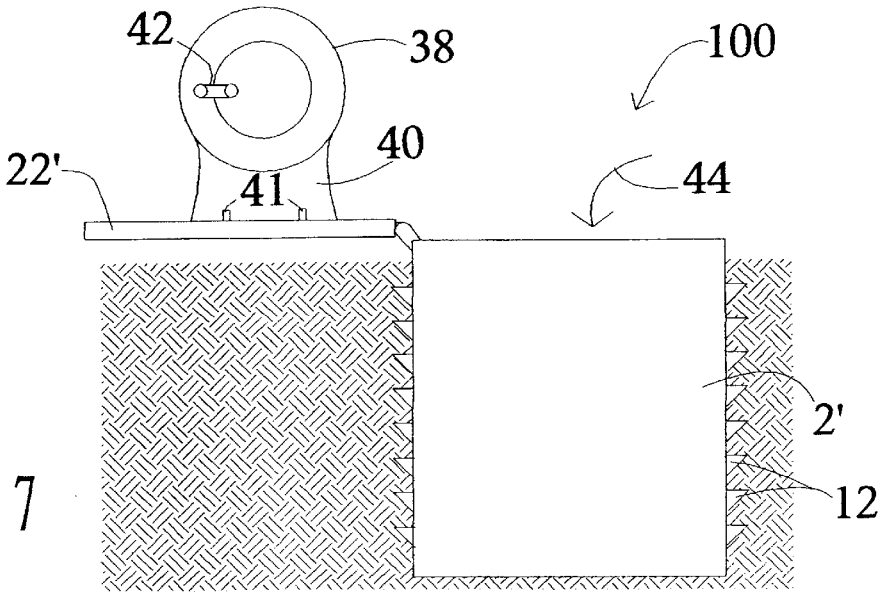
FIG. 7 is an elevational view of an alternative hose storage device according to the present invention.
Figure 9:
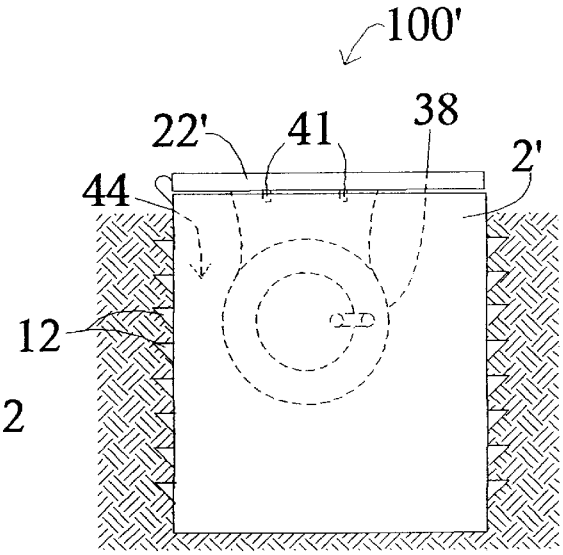
FIG. 9 is an elevational view of the hose storage device of FIG. 7 in its closed position.

FIG. 7 illustrates an alternative hose concealing device 100'. The main housing 2' with its stabilizing teeth 12 is buried beneath the surface of the ground. A hose reel 38 is mounted to a lid 22' by a mounting bracket 40 and mounting hardware 41. The hose reel 38 is provided with a crank 42 for winding and unwinding a hose. FIG. 9 illustrates the closed position for the hose concealing device 100'. The hose and hose reel 38 are stored within the hose storage area 44. When it is desirable to use the hose, the lid 22' is simply opened as shown in FIG. 7 to allow access to the hose. This embodiment is best suited for those situations where a single size hose will be used and there is less likelihood of somebody accidentally falling within the hose storage area 44 when the lid 22 is opened. This is a simple and inexpensive alternative to the hose storage device 100.

Figure 8:
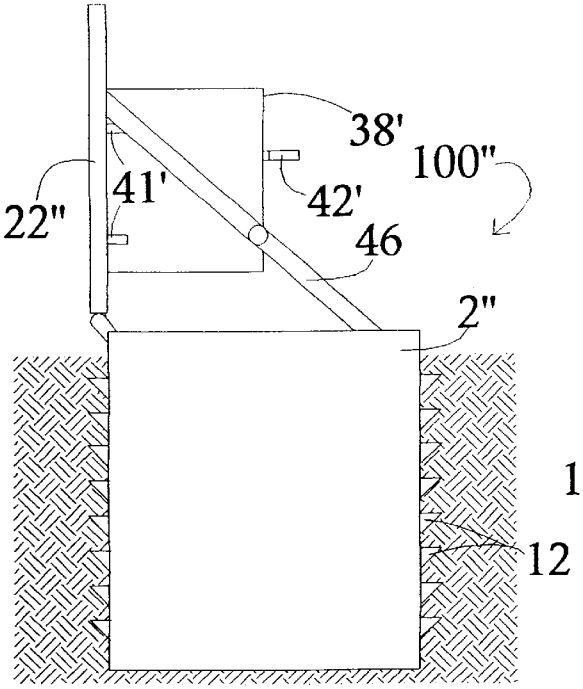
FIG. 8 is an elevational view of yet another alternative hose storage device according to the present invention.

FIG. 8 illustrates yet another alternative hose concealing device 100". In this embodiment, the lid 22" is only able to open into a vertical position, as compared to the lid 22' in FIG. 7 which is not so limited. A bracket or brace 46 is provided on each side of the lid 22" to lock the lid into place, thereby stabilizing the hose and hose reel 38' for use. To close the lid 22" and, therefore, conceal the hose and hose reel 38, the braces 46 are simply manipulated to allow the lid 22" to close. The result is much like that observed in FIG. 9. The configuration of FIG. 8 can lead to a shallower main housing 2" as compared to the main housing 2' of FIG. 7 because the mounting bracket 38' is parallel with the ground as opposed to being perpendicular to the ground.

Concerning the embodiments shown in FIGS. 7 and 8, if desired, the hose and hose reel 38 and 38' can simply be removed and stored in different locations, such as a garage or basement during cold winter months.

Figures 10, 11, 12:
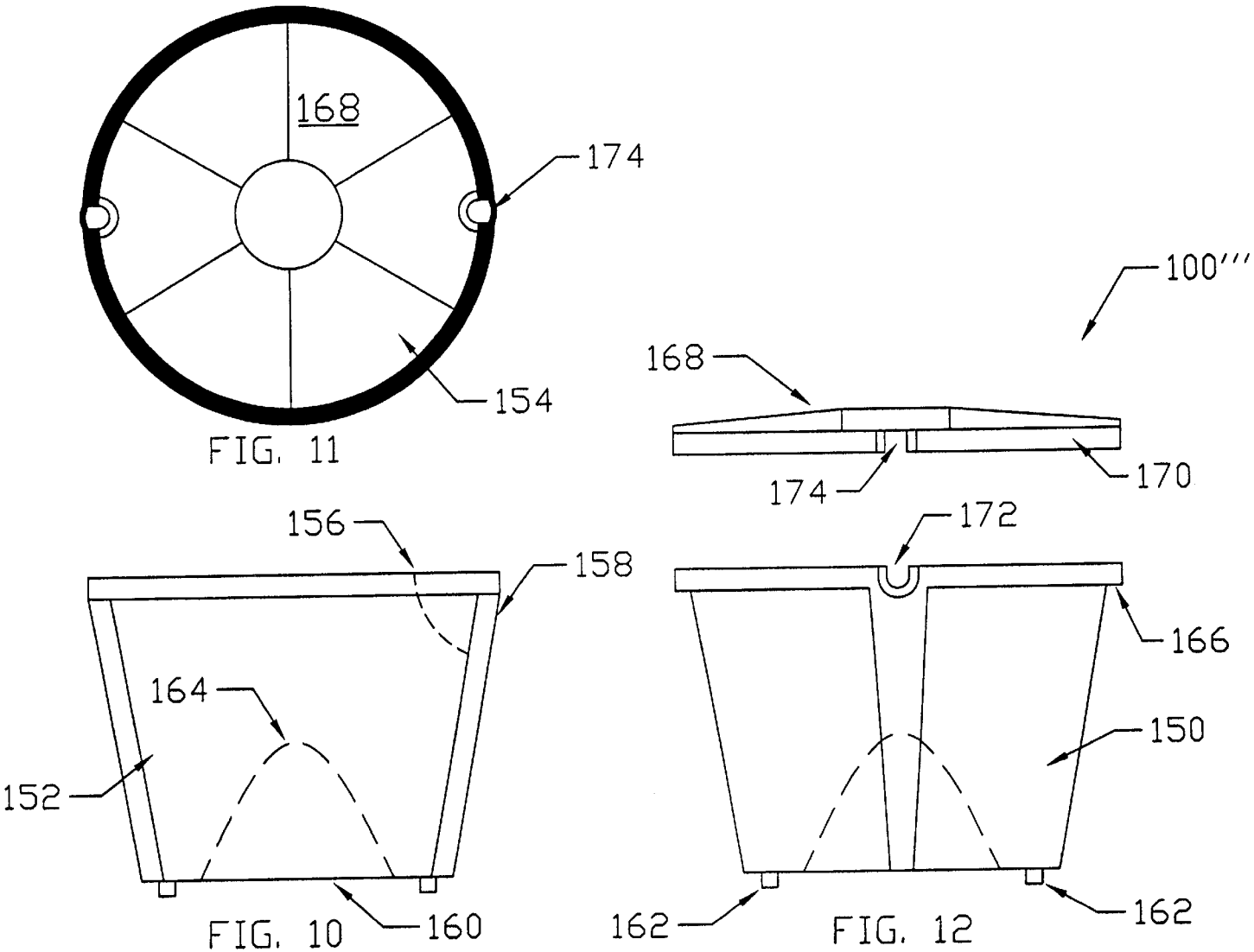
FIG. 10 is a side plan view of yet another alternative hose storage device according to the present invention.
FIG. 11 is a top view of the hose storage device of FIG. 10.
FIG. 12 is an exploded view of the hose storage device of FIGS. 10 and 11.

FIGS. 10–12 illustrate yet another hose storage device 100'". A box-like container 150 is provided which can be recessed below the ground surface or placed on top of the ground surface. Preferably, the container 150 includes a one-piece generally cylindrically shaped main body 152 and a lid 154. The main body 152 includes an inner surface 156, an outer surface 158 and a bottom 160. Although not shown, the bottom 160 can include weep holes for the same reasons previously stated. A plurality of feet 162 or other support structure may be provided on the bottom 160 to further enhance the drainability of the container 150, such as if the container 150 is place on top of a pile of gravel or pea rock. A support column 164 such as a tapered cone is preferably provided on the bottom 160 of and within the main body 152, around which a hose can be coiled and uncoiled. A ledge or lip 166 extends around the inner surface 156 of the main body 152. The lid 154 rests on the ledge 166 when the container 150 is closed. The lid 154 includes a top side 168 and a side wall 170 extending from the top side 168. Since the lid 154 is preferably circular to mate with the top of the main body 152, the side wall 170 is annular. Advantageously, the main body 152 includes at least one groove or slot 172 in a top portion thereof, which groove 172 extends through the inner surface 156 and the outer surface 158. The lid 154 includes at least one groove or slot 174 which extends through the top side 168 and side wall 170. In this way, a hose can be pulled out of or retracted into the container 150 through the lid 154, or the hose can be pulled out of or retracted into the container 150 through a side of the main body.

Variations and modifications of the foregoing are within the scope of the present invention. For example, it is preferable that the hose concealing device of the present invention be made of a plastic material, but it can be made of other materials suitable for a particular application. As another example, although not mentioned in describing the hose concealing device 100 of FIGS. 1–6, the hose and hose rest 28 could be removed from the main housing 2 for storage in other locations during cold weather months, just as the hose and hose reel 38 of FIG. 7 can be removed and stored elsewhere. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A hose storage device comprising:

a main body having an inner surface and an outer surface, each extending between an uppermost surface and a bottom end, a ledge extending inward from the inner surface, and an open area defined at least in part by the inner surface, the bottom end and the ledge, and the main body further having a groove extending through the uppermost surface, the outer surface and the inner surface; and a lid adapted for placement on the ledge of the main body to substantially close the open area of the main body, the lid having an opening configured to be alignable with the groove in the main body such that a hose can pass through the opening in the lid or the groove in the main body or both.

2. A hose storage device as set forth in claim 1, wherein the lid includes a top side and a side wall extending from the top side, and wherein the opening in the lid extends through both the top side and the side wall of the lid.

3. A hose storage device as set forth in claim 2, wherein the main body is a generally cylindrical container, and the lid is substantially circular.

4. A hose storage device as set forth in claim 1, further comprising a column extending upward from the bottom end and into the open area of the main body, around which a hose can be coiled and uncoiled.

5. A hose storage device as set forth in claim 4, wherein the column is in the shape of a tapered cone.

6. A hose storage device as set forth in claim 4, wherein the column is integrally formed with the main body to create a one piece plastic structure.

7. A hose storage device as set forth in claim 1, wherein the bottom end includes a plurality of drainage apertures.

8. A hose storage device as set forth in claim 1, further comprising at least one supporting foot extending from the bottom end of the main body, thereby locating the main body above a supporting surface for improved drainability.

9. A hose storage device as set forth in claim 1, further comprising a plurality of stabilizing teeth extending outward from the outer surface of the main body so as to assist in securing the main body under ground surface when the main body is positioned beneath the ground surface.

10. A hose storage device comprising:

a container placed under ground, the container having a top end which is substantially flush and parallel with the ground surface;

a lid pivotally connected to the container to open and close the container; and a hose reel mounted to the lid, such that when it is desirable to use a hose supported by the hose reel, the lid is opened and pivoted until such time as a top surface of the lid rests upon the ground surface.

11. A hose storage device as set forth in claim 10, further comprising a releasable brace member operatively connected to the container and the lid, such that when the lid is opened to allow access to the hose supported by the hose reel, the brace member locks the lid in a substantially vertical position so that the lid cannot continue to pivot all the way to the ground surface.

12. A hose storage device as set forth in claim 10, further comprising a plurality of stabilizing teeth extending outward from the container to assist in securing the container within the ground.

13. A hose storage device comprising:

a container having a top end and a bottom end;

a hose rest for supporting a hose, the hose rest being adjustably positioned within the container at varying depths within the container; and a lid which is pivotally connected to the container to conceal a hose supported by the hose rest when the lid is closed, and to allow access to the hose supported by the hose rest when the lid is opened.

14. A hose storage device as set forth in claim 13, wherein the container includes a traveling groove on an inside surface thereof, and wherein the hose rest includes a tab adapted to move up and down the groove as the hose rest is adjustably positioned within the container.

15. A hose storage device as set forth in claim 14, wherein the container includes a hose rest locking groove associatively connected to the traveling groove, such that the hose rest locking groove is adapted to receive the tab of the hose rest to secure the hose rest into a position within the container.

16. A hose storage device as set forth in claim 13, wherein the hose rest includes a column around which a hose can be coiled and uncoiled.

17. A hose storage device as set forth in claim 16, wherein the hose rest includes a handle extending within the column for ease of moving the hose rest.

18. A hose storage device as set forth in claim 16, wherein the column includes an open storage area for storing small hand tools or other appropriate accessories.

19. A hose storage device as set forth in claim 13, wherein the bottom end of the container and the hose rest include drainage apertures.

20. A hose storage device as set forth in claim 13, wherein the lid includes a hole to allow a hose to pass therethrough.

21. A hose storage device as set forth in claim 13, further comprising a plurality of stabilizing members extending outward from the container to assist is securing the container within the ground when positioned within the ground.

22. A hose storage device as set forth in claim 13, wherein the container is a modularized container comprising a first portion and a second portion releasably attached to the first portion, and wherein the bottom end is releasably attached to the first and second portions.

* * * * *